US009758887B2

(12) United States Patent
Goto et al.

(10) Patent No.: US 9,758,887 B2
(45) Date of Patent: Sep. 12, 2017

(54) METHOD FOR PRODUCING ALUMINUM FILM

(71) Applicant: SUMITOMO ELECTRIC INDUSTRIES, LTD., Osaka-shi, Osaka (JP)

(72) Inventors: Kengo Goto, Osaka (JP); Akihisa Hosoe, Osaka (JP); Junichi Nishimura, Osaka (JP); Kazuki Okuno, Osaka (JP); Koutarou Kimura, Osaka (JP); Hideaki Sakaida, Osaka (JP)

(73) Assignee: SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 350 days.

(21) Appl. No.: 14/426,795

(22) PCT Filed: Aug. 22, 2013

(86) PCT No.: PCT/JP2013/072436
§ 371 (c)(1),
(2) Date: Mar. 9, 2015

(87) PCT Pub. No.: WO2014/038389
PCT Pub. Date: Mar. 13, 2014

(65) Prior Publication Data

US 2015/0225865 A1 Aug. 13, 2015

(30) Foreign Application Priority Data

Sep. 10, 2012 (JP) ..... 2012-198035

(51) Int. Cl.
*C25D 3/66* (2006.01)
*C25D 3/44* (2006.01)

(52) U.S. Cl.
CPC ..... *C25D 3/66* (2013.01); *C25D 3/44* (2013.01); *C25D 3/665* (2013.01)

(58) Field of Classification Search
CPC ..... C25D 3/665; C25D 3/66; C25D 3/44
(Continued)

(56) References Cited

U.S. PATENT DOCUMENTS 5,543,522 A * 8/1996 Kawahara ..... C07D 213/20 106/1.22
2012/0031766 A1* 2/2012 Inoue ..... C25D 3/44 205/102
2013/0001092 A1* 1/2013 Abbott ..... C07C 233/05 205/238

FOREIGN PATENT DOCUMENTS

CN 1749440 A 3/2006
CN 102575375 A 7/2012
(Continued)

OTHER PUBLICATIONS

Hadi M. A. Abood et al., "Do all ionic liquids need organic cations? Characterisation of $[AlCl_2\ nAmide]^+\ AlCl_4^-$ and comparison with imidazolium based systems," Chemical Communications, Mar. 28, 2011, pp. 3523-3525, vol. 47, No. 12.
(Continued)

*Primary Examiner* — Brian W Cohen
(74) *Attorney, Agent, or Firm* — Drinker Biddle & Reath LLP

(57) ABSTRACT

Provided is a method for producing an aluminum film having a mirror surface and reduced residual stress. A method for producing an aluminum film includes electrodepositing aluminum on a surface of a substrate in an electrolyte solution, in which the electrolyte solution is obtained by adding, to a molten salt composed of aluminum chloride and an alkylimidazolium chloride, at least one compound A selected from the group consisting of an organic solvent, an organic polymer compound having a number-average molecular weight of 200 to 80,000, and a nitrogen-contain-
(Continued)

ing heterocyclic compound having 3 to 14 carbon atoms, and a compound B having an amino group.

5 Claims, 5 Drawing Sheets

(58) Field of Classification Search
USPC ..... 205/233, 237
See application file for complete search history.

(56) References Cited

FOREIGN PATENT DOCUMENTS

| | | | | | |
|---|---|---|---|---|---|
| EP | 0404188 | A1 | | 12/1990 | |
| JP | EP 0339536 | A1 | * | 11/1989 | ..... C25D 3/44 |
| JP | H03-28391 | A | | 2/1991 | |
| JP | H05-51785 | A | | 3/1993 | |
| WO | WO-2012/093668 | A1 | | 7/2012 | |

OTHER PUBLICATIONS

Lian Liu et al., "Influence of Additives on the Speciation, Morphology, and Nanocrystallinity of Aluminium Electrodeposition," Australian Journal of Chemistry, Sep. 18, 2012, pp. 1523-1528, vol. 65, No. 11.

Koichi Hiratsuka et al., "Effect of Microcracks and Residual Stress of Cr Plating Layer on Fatigue Strength," Journal of the Surface Finishing Society of Japan, 2004, pp. 91-92, vol. 55, No. 1, including partial English translation.

* cited by examiner

METHOD FOR PRODUCING ALUMINUM FILM

TECHNICAL FIELD

The present invention relates to a method for producing an aluminum film having reduced residual stress and a mirror surface.

BACKGROUND ART

Metal plating is widely performed in order to impart metallic luster to surfaces of substrates and to enhance corrosion resistance and rust prevention.

However, it is known that, for example, the fatigue strength of a member subjected to usual chrome plating is lower than the fatigue strength of the member before being subjected to plating. This is considered to be caused by tensile residual stress and microcracks occurring in the chrome plating layer formed on the surface of the member. Furthermore, if microcracks reach the underlying member, corrosion resistance will be degraded.

In order to overcome such a problem, for example, Non Patent Literature 1 reports that by forming a chrome plating layer having high compressive residual stress and having no microcracks on the surface of a substrate by controlling pulse conditions in pulse electrolysis, the fatigue strength of the substrate may be increased by 30%.

CITATION LIST

Non Patent Literature

NPL 1: Koichi Hiratsuka and three others: "Effect of microcracks and residual stress of chrome plating layer on fatigue strength", Journal of the Surface Finishing Society of Japan 2004, vol. 55, No. 1, pp. 91-92

SUMMARY OF INVENTION

Technical Problem

As described above, regarding aqueous solution-based plating, such as chrome plating or nickel plating, there is a lot of information on residual stress. On the other hand, regarding an aluminum plating method using a molten salt, there are no findings so far on residual stress.

In view of the problems described above, it is an object of the present invention to provide a method for producing an aluminum film having a mirror surface and reduced residual stress.

Solution to Problem

In order to solve the problems described above, the present inventors have first analyzed residual stress in an aluminum film obtained using a molten salt. As a result, it has been confirmed that when plating is performed using a plating solution in which 1-ethyl-3-methylimidazolium chloride (EMIC) and aluminum chloride ($AlCl_3$) are mixed at a mixing ratio (by mole) of 1:2, without any additives, compressive stress remains in the aluminum film.

Furthermore, it has been found that when an organic compound, such as m-xylene or 1,10-phenanthroline, is added as an additive to the plating solution, an aluminum film having specular gloss is obtained, and large tensile stress remains in the aluminum film. In this case, it has been confirmed that when a substrate on which the aluminum film is formed is likely to deform, warpage occurs after plating, and when the substrate is unlikely to deform or is fixed so as not to deform, cracks occur in the aluminum film having a mirror surface, or separation occurs.

For example, in the case where 1,10-phenanthroline is added to the molten salt composed of 1-ethyl-3-methylimidazolium chloride and aluminum chloride, as the additive concentration increases, an aluminum film having higher gloss is obtained. However, it has been found that when residual stress is 6 $kg/mm^2$ or more, adhesion between the substrate and the aluminum film decreases, and separation of the aluminum film is likely to occur.

If it is possible to decrease the residual stress of such an aluminum film having a glossy mirror surface, an aluminum film having good appearance and adhesion can be obtained. Accordingly, studies have been conducted in which in order to decrease the residual stress of an aluminum film, various additives are added to the molten salt, and changes in residual stress of the resulting aluminum films are checked.

As a result, it has been found that a method is effective in which an aluminum film is produced using an electrolyte solution obtained by adding at least one compound A selected from the group consisting of an organic solvent, an organic polymer compound having a number-average molecular weight of 200 to 80,000, and a nitrogen-containing heterocyclic compound having 3 to 14 carbon atoms and a compound B having an amino group, to a molten salt composed of aluminum chloride and an alkylimidazolium chloride, and thus the present invention has been completed.

That is, the present invention is characterized as follows:

(1) A method for producing an aluminum film includes electrodepositing aluminum on a surface of a substrate in an electrolyte solution, in which the electrolyte solution is obtained by adding, to a molten salt composed of aluminum chloride and an alkylimidazolium chloride, at least one compound A selected from the group consisting of an organic solvent, an organic polymer compound having a number-average molecular weight of 200 to 80,000, and a nitrogen-containing heterocyclic compound having 3 to 14 carbon atoms, and a compound B having an amino group.

By the method for producing an aluminum film according to (1), it is possible to produce an aluminum film having a mirror surface and reduced residual stress.

(2) In the method for producing an aluminum film according to (1), the alkyl group in the alkylimidazolium chloride has 1 to 5 carbon atoms.

In the invention according to (2), it is possible to obtain an aluminum film using the molten salt in a liquid state at lower temperature.

(3) In the method for producing an aluminum film according to (1) or (2), the compound A is 1,10-phenanthroline.

In the invention according to (3), it is possible to obtain an aluminum film having a better mirror surface.

(4) In the method for producing an aluminum film according to any one of (1) to (3), the compound B is at least one selected from the group consisting of an alkylammonium chloride and a urea compound represented by the formula (1) below.

[Chemical formula 1]

Formula (1)

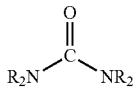

In the formula (1), R is a hydrogen atom, an alkyl group having 1 to 6 carbon atoms, or a phenyl group and two Rs may be the same or different.

In the invention according to (4), it is possible to obtain an aluminum film having less residual stress.

(5) In the method for producing an aluminum film according to any one of (1) to (4), the compound B is dimethylurea or dimethylammonium chloride.

In the invention according to (5), it is possible to obtain an aluminum film having less residual stress at a low cost.

(6) In the method for producing an aluminum film according to (5), the compound A is 1,10-phenanthroline and the concentration thereof in the electrolyte solution is 1 to 2 g/L; and the compound B is dimethylurea and the concentration thereof in the electrolyte solution is 5 to 15 g/L.

In the invention according to (6), it is possible to obtain an aluminum film having a better mirror surface and much less residual stress.

Advantageous Effects of Invention

According to the present invention, a method for producing an aluminum film having a mirror surface and reduced residual stress is provided.

DESCRIPTION OF EMBODIMENTS

Figure 1:
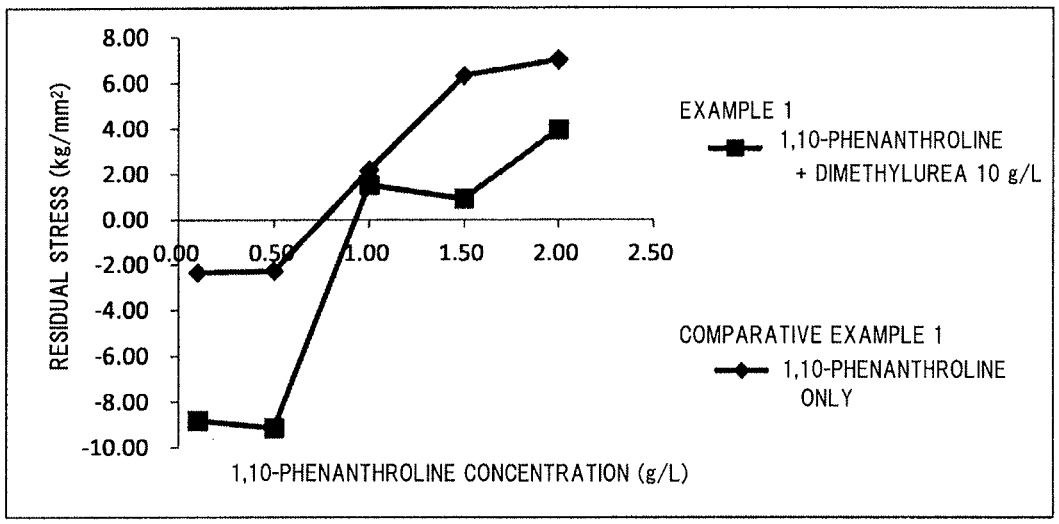
FIG. 1 is a graph showing the measurement results of residual stress of aluminum films obtained in Example 1 and Comparative Example 1.

A method for producing an aluminum film according to the present invention includes electrodepositing aluminum on a surface of a substrate in an electrolyte solution, in which the electrolyte solution is obtained by adding, to a molten salt composed of aluminum chloride and an alkylimidazolium chloride, at least one compound A selected from the group consisting of an organic solvent, an organic polymer compound having a number-average molecular weight of 200 to 80,000, and a nitrogen-containing heterocyclic compound having 3 to 14 carbon atoms and a compound B having an amino group.

As described above, in the present invention, an aluminum film is produced using an electrolyte solution obtained by adding a compound A and a compound B, as additives, to a molten salt. The compound A is an additive that can allow the resulting aluminum film to have a glossy mirror surface. If the compound A only is used, tensile stress will remain in the aluminum film. In the present invention, by further adding the compound B to the molten salt, it is possible to reduce the residual stress of the resulting aluminum film.

Note that, in the present invention, the term "residual stress" means both compressive stress and tensile stress. For the sake of convenience, compressive residual stress is represented by a negative value, and tensile residual stress is represented by a positive value.

As the molten salt, a molten salt composed of aluminum chloride and an alkylimidazolium chloride is used. As the alkylimidazolium chloride, any alkylimidazolium chloride that forms a molten salt when mixed with aluminum chloride may be used, and for example, a salt containing an imidazolium cation having alkyl groups (having 1 to 5 carbon atoms) at the 1- and 3-positions is preferably used.

As the molten salt, in particular, an aluminum chloride-1-ethyl-3-methylimidazolium chloride ($AlCl_3$-EMIC) molten salt can be most preferably used because it has high stability and is unlikely to decompose.

As the compound A, at least one compound selected from the group consisting of an organic solvent, an organic polymer compound having a number-average molecular weight of 200 to 80,000, and a nitrogen-containing heterocyclic compound having 3 to 14 carbon atoms is used.

As the organic solvent, for example, benzene, xylene, toluene, tetralin, or the like can be preferably used. As the organic polymer compound having a number-average molecular weight of 200 to 80,000, for example, polystyrene, polyethylene glycol, polyvinyl chloride, polypropylene, or the like can be preferably used. Furthermore, as the nitrogen-containing heterocyclic compound having 3 to 14 carbon atoms, for example, 1,10-phenanthroline, benzotriazole, pyridine, pyrazine, bipyridine, or the like can be preferably used.

Among these, 1,10-phenanthroline can be particularly preferably used.

As the concentration of the compound A in the electrolyte solution increases, the surface of the resulting aluminum film becomes smoother. Since this effect varies depending on the type of the compound A, the concentration of the compound A to be added into the electrolyte solution may be appropriately set in accordance with the surface state of the resulting aluminum film.

For example, in the case where the compound A is 1,10-phenanthroline, preferably, 1,10-phenanthroline is added at a concentration of 1 to 2 g/L into the electrolyte solution. By setting the concentration of 1,10-phenanthroline in the electrolyte solution to be 1 g/L or more, it is possible to obtain an aluminum film which is smooth and glossy so as to form a mirror surface. By setting the concentration to be 2 g/L or less, the tensile stress remaining in the resulting aluminum film can be reduced.

Furthermore, the compound A is partially incorporated into the aluminum film in the step of electrodepositing the aluminum film, and thus the concentration of the compound A in the electrolyte solution decreases as the electrodeposition progresses. Therefore, preferably, plating is performed while appropriately replenishing the loss.

The compound B is preferably at least one selected from the group consisting of an alkylammonium chloride and a urea compound represented by the formula (1) below.

[Chemical formula 1]

Formula (1)

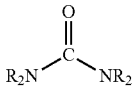

In the formula (1), R is a hydrogen atom, an alkyl group having 1 to 6 carbon atoms, or a phenyl group and two Rs may be the same or different.

The number of carbon atoms possessed by the alkyl group in the alkylammonium chloride is preferably 1 to 5. As the alkylammonium chloride, for example, dimethylammonium chloride, trimethylammonium chloride, tetramethylammonium chloride, or the like can be preferably used. Among these, dimethylammonium chloride can be particularly preferably used.

Furthermore, as the urea compound represented by the formula (1), urea, dimethylurea, dipropylurea, phenylurea, or the like can be preferably used. Among these, dimethylurea can be particularly preferably used.

As described above, the compound A has the effect of smoothing the surface of the aluminum film, and at the same time, generates tensile stress in the aluminum film. The compound B has the effect of relieving the tensile stress. Therefore, the concentration of the compound B to be added into the electrolyte solution may be appropriately set in accordance with the magnitude of the tensile stress applied to the aluminum film by the compound A.

For example, in the case where 1,10-phenanthroline, as the compound A, is added at a concentration of 1 to 2 g/L into the electrolyte solution and dimethylurea is used as the compound B, preferably, dimethylurea is added such that the concentration of dimethylurea in the electrolyte solution is 5 to 15 g/L. By setting the concentration of dimethylurea in the electrolyte solution to be 5 g/L or more, it is possible to reduce the residual stress (tensile stress) in the aluminum film due to addition of 1,10-phenanthroline. By setting the concentration of dimethylurea in the electrolyte solution to be 15 g/L or less, it is possible to prevent excessive application of compressive stress to the aluminum film by dimethylurea.

The temperature of the electrolyte solution is preferably 10° C. to 100° C., and more preferably 25° C. to 60° C. By setting the temperature of the electrolyte solution at 10° C. or higher, it is possible to sufficiently secure the current density range required for formation of the aluminum film. By setting the temperature at 100° C. or lower, it is possible to reduce the cost required for heating.

A method for producing an aluminum film according to the present invention includes electrodepositing aluminum on a surface of a substrate using the electrolyte solution having the composition described above. In order to electrodeposit aluminum in the electrolyte solution, a substrate serving as a cathode is electrically connected to an anode. As the anode, for example, an aluminum plate or the like is used.

By the method described above, an aluminum film having a mirror surface and reduced residual stress is obtained. Specifically, in either the case where the stress remaining in the aluminum film is compressive stress or the case where it is tensile stress, the amount of stress can be set to be 6 $kg/mm^2$ or less, and thus it is possible to obtain an aluminum film having high adhesion with the substrate.

Furthermore, the surface of the resulting aluminum film is sufficiently smooth and in the mirror surface state. That is, it is possible to obtain a smooth aluminum film with an arithmetic mean roughness Ra of 0.03 μm or less.

The method for producing an aluminum film according to the present invention allows an aluminum film having a mirror surface and gloss to be formed on surfaces of various substrates. The aluminum film has excellent adhesion with a substrate and excellent workability after plating, and therefore, can be used in various fields.

For example, when an aluminum film is formed by the production method of the present invention on a surface of a terminal for connecting a conductor that uses aluminum, it is possible to avoid connection between dissimilar metals, and electrical resistance can be decreased. Furthermore, by forming an aluminum film on a steel sheet or the like, corrosion resistance is improved.

EXAMPLES

The present invention will be described in more detail below on the basis of examples. However, the examples are merely illustrative and the method for producing an aluminum film of the present invention is not limited thereto. It is intended that the scope of the present invention is determined by appended claims, and includes all variations of the equivalent meanings and ranges to the claims.

Example 1

(Electrolyte Solution)

A molten salt was prepared by mixing 1-ethyl-3-methylimidazolium chloride (EMIC) and aluminum chloride ($AlCl_3$) at a mixing ratio (by mole) of 1:2. Dimethylurea, as a compound B, was added at a concentration of 10 g/L to the molten salt.

Subsequently, electrolyte solutions were prepared by adding 1,10-phenanthroline at a concentration of 0.10, 0.50, 1.00, 1.50, or 2.00 g/L to the resulting molten salt.

(Formation of Aluminum Film)

Using the individual electrolyte solutions prepared above, aluminum films were electrodeposited on surfaces of substrates.

Copper plates were used as the substrates. The substrates were each connected to the negative side of a rectifier, and an aluminum plate (purity 99.99%) as a counter electrode was connected to the positive side. The temperature of each of the electrolyte solutions was set to be 45° C., and the current density was controlled to be 2.5 $A/dm^2$.

Example 2

(Electrolyte Solution)

A molten salt was prepared by mixing 1-ethyl-3-methylimidazolium chloride (EMIC) and aluminum chloride ($AlCl_3$) at a mixing ratio (by mole) of 1:2. 1,10-Phenanthroline, as a compound A, was added at a concentration of 2.00 g/L to the molten salt.

Subsequently, electrolyte solutions were prepared by adding dimethylurea, as a compound B, at a concentration of 1.00, 5.00, 10.00, or 20.00 g/L to the resulting molten salt.

(Formation of Aluminum Film)

Aluminum films were electrodeposited on surfaces of substrates (copper plates) as in Example 1 except that the individual electrolyte solutions prepared as described above were used.

Comparative Example 1

Electrolyte solutions were prepared and aluminum films were formed as in Example 1 except that dimethylurea was not added.

Example 3

(Electrolyte Solution)

A molten salt was prepared by mixing 1-ethyl-3-methylimidazolium chloride (EMIC) and aluminum chloride ($AlCl_3$) at a mixing ratio (by mole) of 1:2. Dimethylurea, as a compound B, was added at a concentration of 10 g/L to the molten salt.

Subsequently, electrolyte solutions were prepared by adding polystyrene with a number-average molecular weight of 40,000, as a compound A, at a concentration of 1.00, 1.50, 2.00, 2.50, or 5.00 g/L to the resulting molten salt.

(Formation of Aluminum Film)

Aluminum films were electrodeposited on surfaces of substrates (copper plates) as in Example 1 except that the individual electrolyte solutions prepared as described above were used.

Comparative Example 2

Electrolyte solutions were prepared and aluminum films were formed as in Example 3 except that dimethylurea was not added.

Example 4

(Electrolyte Solution)

A molten salt was prepared by mixing 1-ethyl-3-methylimidazolium chloride (EMIC) and aluminum chloride ($AlCl_3$) at a mixing ratio (by mole) of 1:2. Dimethylammonium chloride, as a compound B, was added at a concentration of 10 g/L to the molten salt.

Subsequently, electrolyte solutions were prepared by adding 1,10-phenanthroline, as a compound A, at a concentration of 0.10, 0.50, 1.00, 1.50, or 2.00 g/L to the resulting molten salt.

Note that this example is compared to Comparative Example 1.

(Formation of Aluminum Film)

Aluminum films were electrodeposited on surfaces of substrates (copper plates) as in Example 1 except that the individual electrolyte solutions prepared as described above were used.

Example 5

(Electrolyte Solution)

A molten salt was prepared by mixing 1-ethyl-3-methylimidazolium chloride (EMIC) and aluminum chloride ($AlCl_3$) at a mixing ratio (by mole) of 1:2. Dimethylurea, as a compound B, was added at a concentration of 10 g/L to the molten salt.

Subsequently, electrolyte solutions were prepared by adding pyrazine, as a compound A, at a concentration of 0.10, 0.30, 0.50, 0.80, or 1.20 g/L to the resulting molten salt.

(Formation of Aluminum Film)

Aluminum films were electrodeposited on surfaces of substrates (copper plates) as in Example 1 except that the individual electrolyte solutions prepared as described above were used.

Comparative Example 3

Electrolyte solutions were prepared and aluminum films were formed as in Example 5 except that dimethylurea was not added.

(Measurement of Residual Stress of Aluminum Film)

Figure 2:
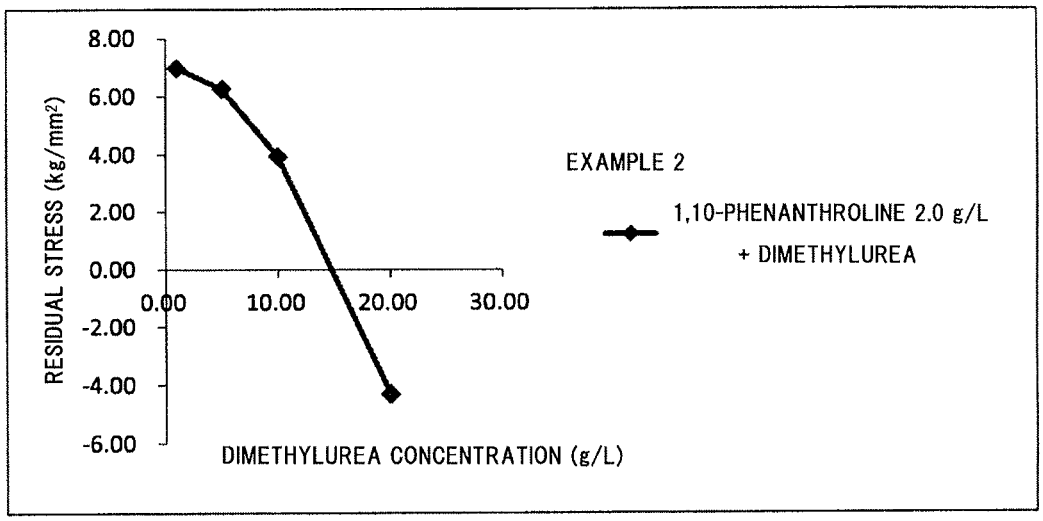
FIG. 2 is a graph showing the measurement results of residual stress of aluminum films obtained in Example 2.
Figure 4:
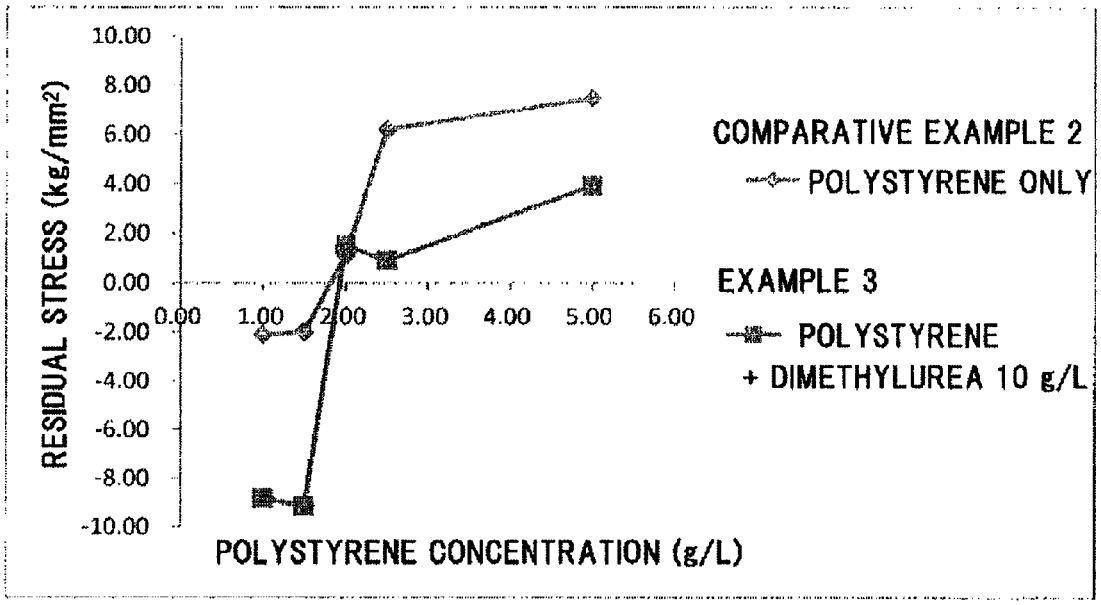
FIG. 4 is a graph showing the measurement results of residual stress of aluminum films obtained in Example 3 and Comparative Example 2.
Figure 6:
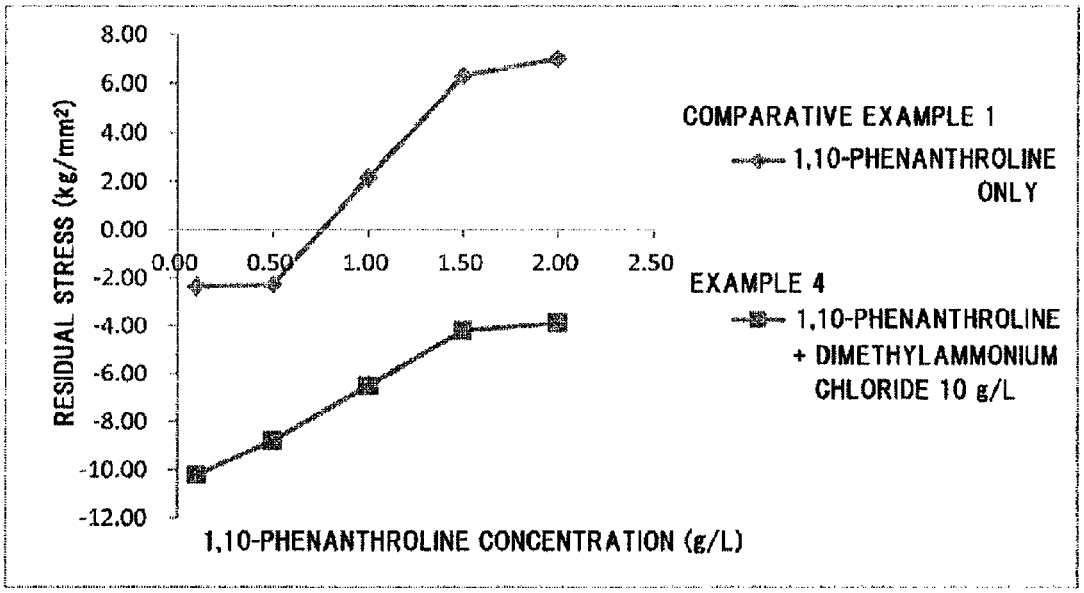
FIG. 6 is a graph showing the measurement results of residual stress of aluminum films obtained in Example 4 and Comparative Example 1.
Figure 8:
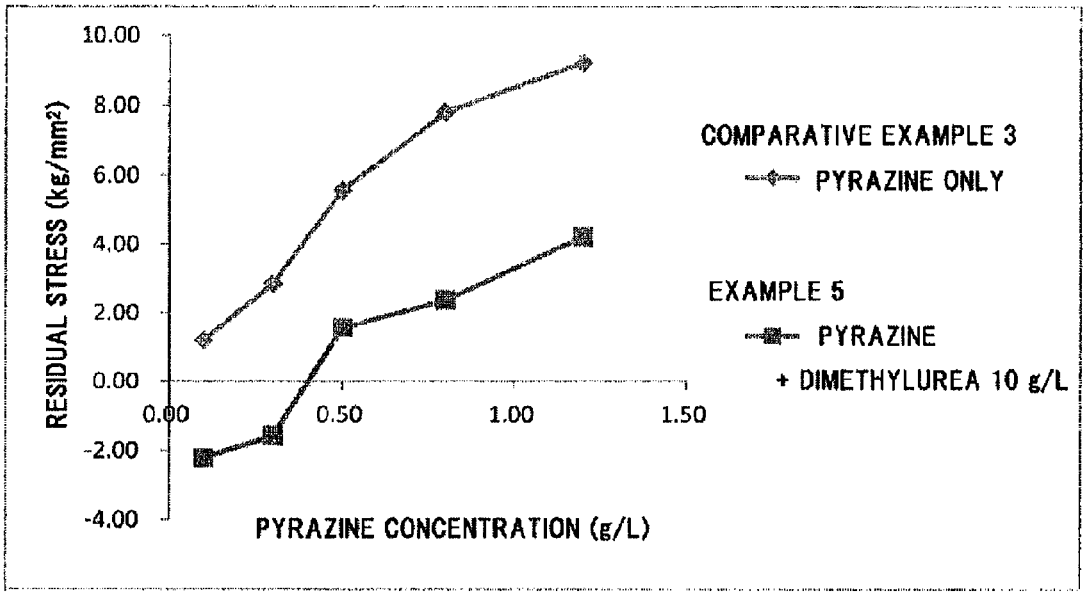
FIG. 8 is a graph showing the measurement results of residual stress of aluminum films obtained in Example 5 and Comparative Example 3.

The residual stress of each of the aluminum films obtained in Examples 1 to 5 and Comparative Examples 1 to 3 was measured by a strip stress test. The results of Examples 1 to 5 are shown in Tables I, II, IV, VI, and VII, and the results of Comparative Examples 1 to 3 are shown in Tables III, V, and VIII. Furthermore, FIG. 1 is a graph which compares the results of Example 1 and the results of Comparative Example 1, and FIG. 2 is a graph showing the results of Example 2. Furthermore, FIG. 4 is a graph which compares the results of Example 3 and the results of Comparative Example 2, FIG. 6 is a graph which compares the results of Example 4 and the results of Comparative Example 1, and FIG. 8 is a graph which compares the results of Example 5 and the results of Comparative Example 3.

(Measurement of Arithmetic Mean Roughness Ra of Aluminum Film)

Figure 3:
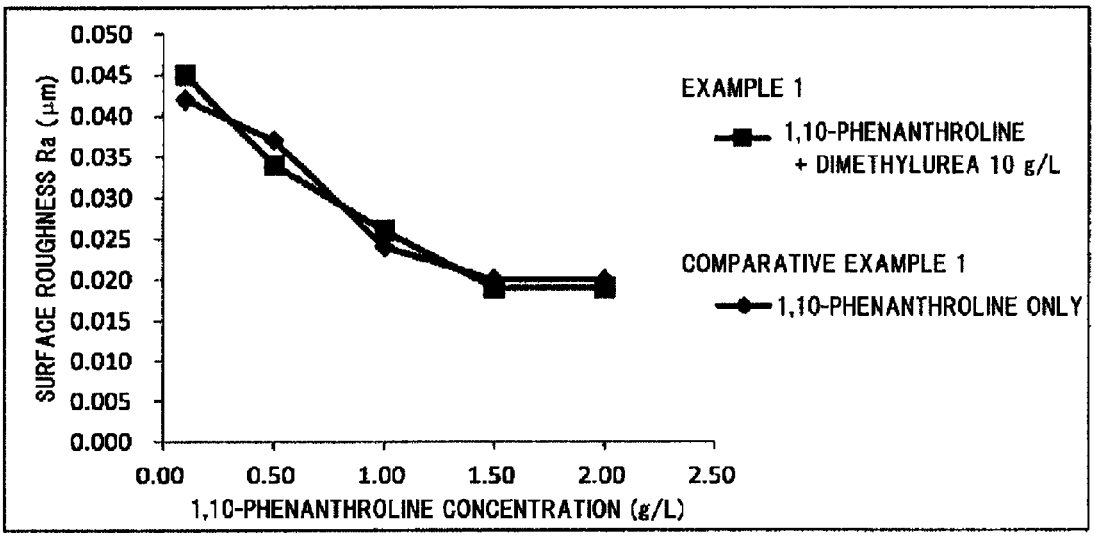
FIG. 3 is a graph showing the measurement results of surface roughness (arithmetic mean roughness) Ra of aluminum films obtained in Example 1 and Comparative Example 1.
Figure 5:
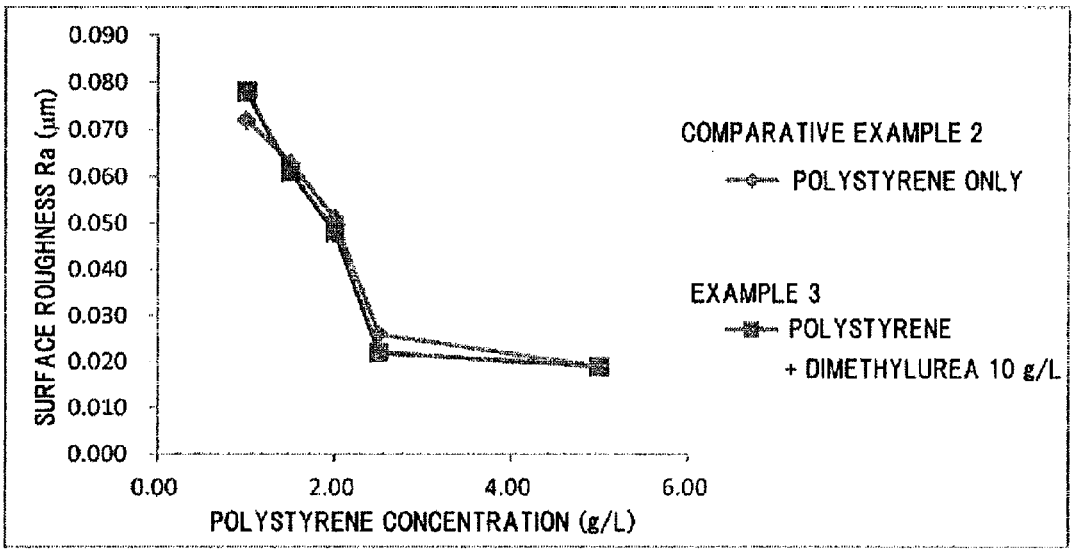
FIG. 5 is a graph showing the measurement results of surface roughness (arithmetic mean roughness) Ra of aluminum films obtained in Example 3 and Comparative Example 2.
Figure 7:
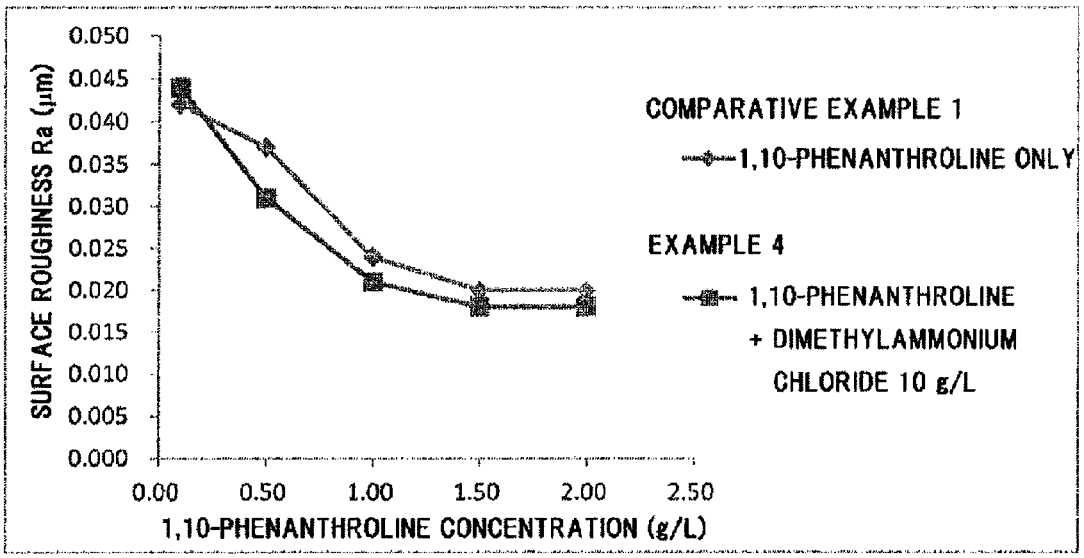
FIG. 7 is a graph showing the measurement results of surface roughness (arithmetic mean roughness) Ra of aluminum films obtained in Example 4 and Comparative Example 1.
Figure 9:
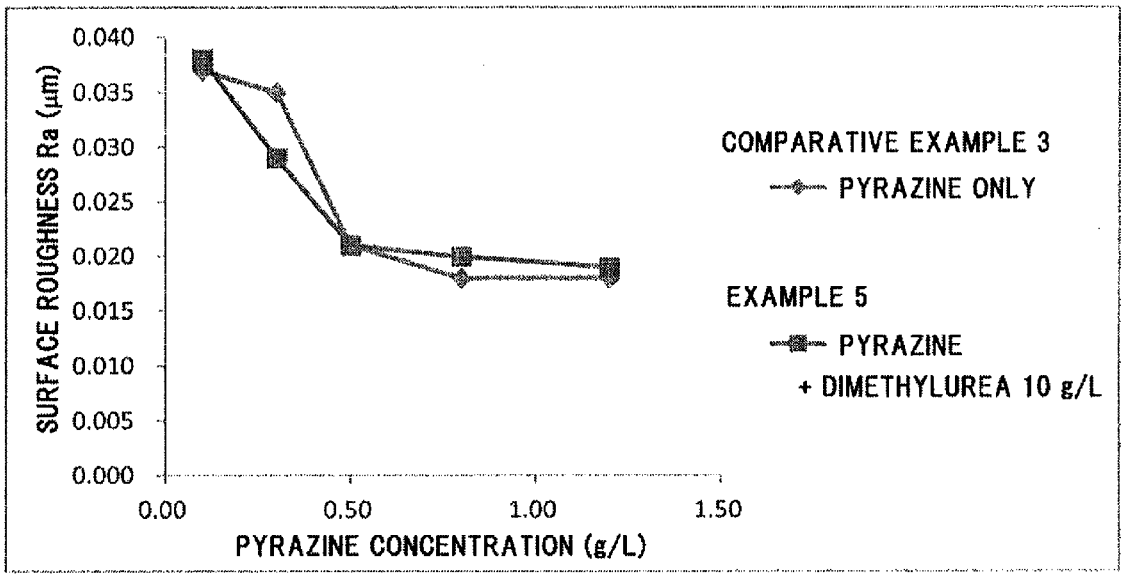
FIG. 9 is a graph showing the measurement results of surface roughness (arithmetic mean roughness) Ra of aluminum films obtained in Example 5 and Comparative Example 3.

The arithmetic mean roughness Ra of each of the aluminum films obtained in Examples 1 to 5 and Comparative Examples 1 to 3 was measured using a laser microscope. The results of Examples 1 to 5 are shown in Tables I, II, IV, VI, and VII, and the results of Comparative Examples 1 to 3 are shown in Tables III, V, and VIII. Furthermore, FIG. 3 is a graph which compares the results of Example 1 and the results of Comparative Example 1, FIG. 5 is a graph which compares the results of Example 3 and the results of Comparative Example 2, FIG. 7 is a graph which compares the results of Example 4 and the results of Comparative Example 1, and FIG. 9 is a graph which compares the results of Example 5 and the results of Comparative Example 3.

TABLE I

| | Example 1 | | | | |
|---|---|---|---|---|---|
| 1,10-Phenanthroline concentration (g/L) | 0.10 | 0.50 | 1.00 | 1.50 | 2.00 |
| Dimethylurea concentration (g/L) | 10.00 | 10.00 | 10.00 | 10.00 | 10.00 |
| Residual stress (kg/mm$^2$) | −8.81 | −9.14 | 1.52 | 0.91 | 3.94 |
| Arithmetic mean roughness Ra (μm) | 0.045 | 0.034 | 0.026 | 0.019 | 0.019 |

TABLE II

| | Example 2 | | | |
|---|---|---|---|---|
| 1,10-Phenanthroline concentration (g/L) | 2.00 | 2.00 | 2.00 | 2.00 |
| Dimethylurea concentration (g/L) | 1.00 | 5.00 | 10.00 | 20.00 |
| Residual stress (kg/mm$^2$) | 7.00 | 6.27 | 3.94 | −4.30 |
| Arithmetic mean roughness Ra (μm) | 0.018 | 0.019 | 0.018 | 0.020 |

TABLE III

| | Comparative Example 1 | | | | |
|---|---|---|---|---|---|
| 1,10-Phenanthroline concentration (g/L) | 0.10 | 0.50 | 1.00 | 1.50 | 2.00 |
| Dimethylurea concentration (g/L) | 0.00 | 0.00 | 0.00 | 0.00 | 0.00 |
| Residual stress (kg/mm$^2$) | −2.34 | −2.27 | 2.16 | 6.31 | 7.00 |
| Arithmetic mean roughness Ra (μm) | 0.042 | 0.037 | 0.024 | 0.020 | 0.020 |

TABLE IV

| | Example 3 | | | | |
|---|---|---|---|---|---|
| Polystyrene concentration (g/L) | 1.00 | 1.50 | 2.00 | 2.50 | 5.00 |
| Dimethylurea concentration (g/L) | 10.00 | 10.00 | 10.00 | 10.00 | 10.00 |
| Residual stress (kg/mm2) | −8.81 | −9.14 | 1.52 | 0.91 | 3.94 |
| Arithmetic mean roughness Ra (μm) | 0.078 | 0.061 | 0.048 | 0.022 | 0.019 |

TABLE V

| | Comparative Example 2 | | | | |
|---|---|---|---|---|---|
| Polystyrene concentration (g/L) | 1.00 | 1.50 | 2.00 | 2.50 | 5.00 |
| Dimethylurea concentration (g/L) | 0.00 | 0.00 | 0.00 | 0.00 | 0.00 |
| Residual stress (kg/mm2) | −2.10 | −1.99 | 1.12 | 6.21 | 7.50 |
| Arithmetic mean roughness Ra (μm) | 0.072 | 0.063 | 0.051 | 0.026 | 0.019 |

TABLE VI

| | Example 4 | | | | |
|---|---|---|---|---|---|
| 1,10-Phenanthroline concentration (g/L) | 0.10 | 0.50 | 1.00 | 1.50 | 2.00 |
| Dimethylammonium chloride concentration(g/L) | 10.00 | 10.00 | 10.00 | 10.00 | 10.00 |
| Residual stress (kg/mm2) | −10.20 | −8.80 | −6.50 | −4.20 | −3.88 |
| Arithmetic mean roughness Ra (μm) | 0.044 | 0.031 | 0.021 | 0.018 | 0.018 |

TABLE VII

| | Example 5 | | | | |
|---|---|---|---|---|---|
| Pyrazine concentration (g/L) | 0.10 | 0.30 | 0.50 | 0.80 | 1.20 |
| Dimethylurea concentration (g/L) | 10.00 | 10.00 | 10.00 | 10.00 | 10.00 |
| Residual stress (kg/mm2) | −2.21 | −1.58 | 1.56 | 2.37 | 4.22 |
| Arithmetic mean roughness Ra (μm) | 0.038 | 0.029 | 0.021 | 0.020 | 0.019 |

TABLE VIII

| | Comparative Example 3 | | | | |
|---|---|---|---|---|---|
| Pyrazine concentration (g/L) | 0.10 | 0.30 | 0.50 | 0.80 | 1.20 |
| Dimethylurea concentration (g/L) | 0.00 | 0.00 | 0.00 | 0.00 | 0.00 |

TABLE VIII-continued

| | Comparative Example 3 | | | | |
|---|---|---|---|---|---|
| Residual stress (kg/mm2) | 1.20 | 2.86 | 5.57 | 7.81 | 9.21 |
| Arithmetic mean roughness Ra (μm) | 0.037 | 0.035 | 0.021 | 0.018 | 0.018 |

In Example 1, the dimethylurea concentration in the electrolyte solution was set to be constant at 10.00 g/L. By setting the 1,10-phenanthroline concentration at 1.00 to 2.00 g/L, it was possible to set the residual stress to be −5 to 5 kg/mm$^2$.

Furthermore, in this case, the arithmetic mean roughness Ra of the surface of the aluminum film was 0.030 μm or less, and it was possible to obtain an aluminum film having a sufficiently smooth mirror surface.

In Example 2, the 1,10-phenanthroline concentration in the electrolyte solution was set to be constant at 2.00 g/L. By setting the dimethylurea concentration at 10.00 to 20.00 g/L, it was possible to set the residual stress to be −5 to 5 kg/mm$^2$. Furthermore, in this case, the arithmetic mean roughness Ra of the surface of the aluminum film was 0.020 μm or less, and it was possible to obtain an aluminum film having a sufficiently smooth mirror surface.

In Example 3, the dimethylurea concentration in the electrolyte solution was set to be constant at 10.00 g/L, and polystyrene with a number-average molecular weight of 40,000 was used as a compound A. By setting the polystyrene concentration at 2.50 to 5.00 g/L, it was possible to obtain an aluminum film having a sufficiently smooth mirror surface in which the residual stress was −5 to 5 kg/mm$^2$, and the arithmetic mean roughness Ra of the surface of the aluminum film was 0.030 μm or less.

In Example 4, dimethylammonium chloride was used as a compound B in the electrolyte solution, the concentration thereof was set to be constant at 10.00 g/L, and 1,10-phenanthroline was used as a compound A. By setting the 1,10-phenanthroline concentration at 1.50 to 2.00 g/L, it was possible to set the residual stress to be −5 to 5 kg/mm$^2$. Furthermore, in this case, the arithmetic mean roughness Ra of the surface of the aluminum film was 0.020 μm or less, and it was possible to obtain an aluminum film having a sufficiently smooth mirror surface.

In Example 5, the dimethylurea concentration in the electrolyte solution was set to be constant at 10.00 g/L, and pyrazine was used as a compound A. By setting the pyrazine concentration at 0.30 to 1.20 g/L, it was possible to obtain an aluminum film having a sufficiently smooth mirror surface in which the residual stress was −5 to 5 kg/mm$^2$, and the arithmetic mean roughness Ra of the surface of the aluminum film was 0.030 μm or less.

The invention claimed is:

1. A method for producing an aluminum film comprising electrodepositing aluminum on a surface of a substrate in an electrolyte solution, wherein the electrolyte solution is obtained by adding, to a molten salt composed of aluminum chloride and an alkylimidazolium chloride, at least one compound A selected from the group consisting of an organic solvent, an organic polymer compound having a number-average molecular weight of 200 to 80,000, and a nitrogen-containing heterocyclic compound having 3 to 14 carbon atoms, and a compound B, wherein the compound B is a urea compound represented by the formula (1) below:

Formula (1)

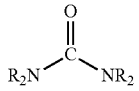

wherein, in the formula (1), R is a hydrogen atom, an alkyl group having 1 to 6 carbon atoms, or a phenyl group and the two Rs may be the same or different.

2. The method for producing an aluminum film according to claim 1, wherein the alkyl group in the alkylimidazolium chloride has 1 to 5 carbon atoms.

3. The method for producing an aluminum film according to claim 1, wherein the compound A is 1,10-phenanthroline.

4. The method for producing an aluminum film according to claim 1, wherein the compound B is dimethylurea.

5. The method for producing an aluminum film according to claim 4, wherein the compound A is 1,10-phenanthroline and the concentration thereof in the electrolyte solution is 1 to 2 g/L; and wherein the compound B is dimethylurea and the concentration thereof in the electrolyte solution is 5 to 15 g/L.

* * * * *